US006510936B2

(12) United States Patent
Smith et al.

(10) Patent No.: US 6,510,936 B2
(45) **Date of Patent: *Jan. 28, 2003**

(54) COIN VALIDATORS

(75) Inventors: Peter Smith, Essendon (AU); Adam Laws, Birchgrove (AU)

(73) Assignee: Microsystems Controls Pty Ltd., Victoria (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,091

(22) Filed: Jul. 23, 1999

(65) Prior Publication Data

US 2001/0040081 A1 Nov. 15, 2001

(30) Foreign Application Priority Data

Jul. 23, 1998 (AU) ..... PP4804

(51) Int. Cl.[7] ..... G07F 1/04
(52) U.S. Cl. ..... 194/346; 194/338; 194/344
(58) Field of Search ..... 194/346, 344, 194/334, 338, 347, 349

(56) References Cited

U.S. PATENT DOCUMENTS

| | | | | | |
|---|---|---|---|---|---|
| 835,292 | A | * | 11/1906 | Stroud | 194/346 |
| 886,499 | A | * | 5/1908 | Harrison | 194/346 X |
| 2,298,009 | A | * | 10/1942 | Grunig | 194/346 X |
| 2,421,857 | A | * | 6/1947 | Tratsch | 194/344 |
| 2,433,689 | A | * | 12/1947 | Fry | 194/344 X |
| 2,640,575 | A | * | 6/1953 | Piano | 194/344 X |
| 3,589,493 | A | * | 6/1971 | Hall | 194/344 X |
| 3,837,454 | A | * | 9/1974 | Joeck | 194/344 X |
| 3,978,962 | A | * | 9/1976 | Gregory, Jr. | 194/344 X |
| 4,333,557 | A | * | 6/1982 | Kozak | 194/346 X |
| 4,334,604 | A | * | 6/1982 | Davies | 194/346 X |
| 4,465,173 | A | * | 8/1984 | Domen et al. | 194/346 X |
| 4,573,485 | A | * | 3/1986 | Nye | 194/346 X |
| 4,582,189 | A | | 4/1986 | Schmitt | 194/346 |
| 4,583,630 | A | * | 4/1986 | Kalishman | 194/344 X |
| 5,217,100 | A | * | 6/1993 | Thompson et al. | 194/346 |
| 5,381,880 | A | * | 1/1995 | Pearson | 194/346 X |
| 5,494,146 | A | * | 2/1996 | Kurosawa et al. | 194/346 X |
| 5,876,275 | A | * | 3/1999 | Rasmussen | 194/344 X |
| 6,085,889 | A | * | 7/2000 | Weickmann | 194/344 X |

FOREIGN PATENT DOCUMENTS

| | | |
|---|---|---|
| FR | 2 401 471 | 3/1979 |
| FR | 2 474 207 | 7/1981 |
| WO | 92/01270 | 1/1992 |
| WO | WO 96/04616 | 2/1996 |

* cited by examiner

*Primary Examiner*—Christopher P. Ellis
*Assistant Examiner*—Thuy V. Tran
(74) *Attorney, Agent, or Firm*—Merchant & Gould P.C.

(57) ABSTRACT

A validator for coins including a coin entry (11) though which a coin (12) can pass to enter the validator, coin exit (4, 5) through which the coin can pass as it leaves the validator, and at least one coin rail (1) upon which the coin (12) rolls upon entry into the validator until just prior to exiting the validator, the coin (12) remaining in continuous contact (as defined herein) with the at least one coin rail (1) as it passes through the validator.

41 Claims, 7 Drawing Sheets

COIN VALIDATORS

FIELD OF THE INVENTION

This invention relates to improvements in coin validators and related coin handling equipment and refers particularly, though not exclusively, to improvements in the coin path within a coin validator. The invention also provides an improved gate at or adjacent the end of the coin path.

DEFINITIONS

Throughout the specification, reference to a coin or coins is to be taken as including reference to a token or slug or other similar device, which is or may be given an actual or nominated value.

Throughout this specification reference to "continuous contact" of a coin with a rail is not to be limited to absolute terms. Non-continuous but substantially continuous contact including control of the coin as it moves from one control surface to another, is encompassed by the term "continuous contact".

BACKGROUND OF THE INVENTION

In any coin operated apparatus the space envelope for the coin validator, and the relative position of coin entry, coin accept and coin reject slots are all defined by an industry standard.

Two general layout options are available. The first is an approximately "S" shape where a coin passes through the validator in a path which approximates the letter "S". It is guided through the detect area of a coin rail. This layout allows the validation of any diameter coin (for example, in the range of 16 to 34 millimeters) without changing the validator's physical configuration. That is, any given coin feed stream can consist of a variety of coin diameters such that the validator is a multi-coin validator.

A typical operation of an S-path validator is described in our Australian Patent Application AU-B81826/91.

The second option is a "drop through" arrangement where a valid coin drops through a detect field directly to the accept slot. Because detect fields are generally not uniform across the full slot width, it is necessary to place coin guides, slightly wider than the maximum coin diameter, within the slots so that the coin passes through the same part of the field each time. This therefore requires a particular slot width for any given coin. These devices are therefore generally single coin validators.

Coin feed rates in most applications are only up to a maximum of 2 to 3 coins per second. This means that the validator need only handle one coin at a time.

However, in the gaming industry, feed rates are controlled by the player and can be up to 15 coins per second, depending on diameter. This means that there can be up to 5 or 6 coins in the validator at any one time. The coin path must be able to serialise these coins so they do not bounce, or overlap each other. This is a difficult problem as fast moving coins striking the various surfaces of an S-path can have random and extreme variations in transitions from one surface to the next.

Coin bounce is also a problem for accurate discrimination. If a coin is bouncing as it enters the detect field, its relative position in the field with respect to the trigger point will vary and, as the field may not be uniform, so will its signature vary. This may lead to the false rejection of coins which are actually valid. It could also lead to acceptance of coins which are in fact invalid.

Random coin bounce can also cause speed variations which in turn can cause coins to often catch up to one another. If two coins have a combined thickness less than the width of the coin path, they can overlap each other. Valid coins overlapping at the detect field will cause those overlapping, valid coins to be rejected.

Coins overlapping after validation as they pass towards the coin accept slot will only be registered as a single coin by the credit recordal mechanism within the validator thus causing a loss of credit, otherwise known as coin steal.

Furthermore, coins overlapping anywhere within the coin path have the potential to cause a coin jam with resultant machine down time, and labour costs to come and clear the machine.

With present validators a coin contacting a reject gate may impart relatively high forces to the gate. Such forces are applied to the solenoid in full or in part such that relatively strong return springs and relatively strong solenoids are required.

It is therefore an object of the present invention to provide a multi-coin validator.

It is a further object of the present invention to provide a validator for coins which addresses the problem of coin bounce and, in consequence, coin overlaps and coin jams for coins of varying size and feed rates.

A further object is to provide a gate for a coin validator where the force of a coin contacting the gate is at an angle of approximately 90° or more to the plane of the longitudinal axis of the solenoid and/or return spring.

BRIEF SUMMARY OF INVENTION

With the above and other objects in mind, the present invention provides a validator for coins (as defined herein) including a coin entry through which a coin can pass to enter the validator, at least one coin exit through which the coin can pass as it leaves the validator, and at least one coin rail upon which the coin rolls upon entry into the validator until just prior to exiting the validator, the coin remaining in continuous contact (as defined herein) with the at least one coin rail as it passes through the validator.

The coin rail may be a continuous rail or may have a number of portions. Preferably, if a number of portions, there may be a first portion, a transfer portion, and an exit portion.

The present invention also provides a validator for coins (as defined herein) including a coin entry through which a coin can pass to enter the validator, at least one coin exit through which the coin can pass as it leaves the validator, and at least one coin rail upon which the coin rolls upon entry into the validator until just prior to exiting the validator, the coin rail having two adjacent surfaces at an included angle of less than 180° to define therebetween a surface intersection line. The surface intersection line causes the coin to rotate thereabout to control the movement of the coin through the validator.

Preferably, the coin rail includes a first side wall extending generally upwardly from a base, a first side wall having an upper portion extending upwardly from a lower portion at the included angle relative thereto.

Advantageously, the base has a first portion extending outwardly from and generally perpendicular to the lower portion of the first side wall. The base may also have a second portion extending outwardly and upwardly from the first portion; and a third portion extending further outwardly and further upwardly from the second portion.

There may be provided a second side wall spaced from and generally parallel to the upper portion of the first side wall, and which may be opposite and aligned with the upper portion of the first side wall. The second side wall may extend downwardly below the surface intersection line.

Preferably, the lower portion of the first side wall is of a lesser height than the diameter of a coin to pass therealong.

The coin rail has a second portion which may have a second base and a further side wall generally spaced from but adjacent to the second base and an outlet end of an intermediate wall respectively.

Advantageously, there is provided a release plate having an inner surface contactable by a coin; the release plate preferably being aligned with the first portion of the coin rail. The release plate may extend downwardly beyond the surface intersection line.

The present invention also provides a gate for a coin validator, including a solenoid, a mechanism operated by the solenoid to move the gate between a first position to allow a coin to pass, and a second position to deflect the coin, the mechanism being locked when in the second position.

The mechanism may include a yoke fitted to the outer end of a plunger of the solenoid. The plunger may be biased to an outer position. Preferably, the yoke has at least one pin extending outwardly therefrom, the pin being located in a somewhat "S" shaped slot in a side of the gate. The gate may have a first end with a projection which, when in the second position, extends into a coin path to act upon the coin, and a second end about which the gate can pivot such that, upon the solenoid being operated, the yoke can move to enable the pins to move along the path prescribed by the slot in the side of the gate. The movement of the pins forces the gate to pivot about the second end to remove the first end from the coin path, thus placing the gate in the first position.

BRIEF DESCRIPTION OF DRAWINGS

In order that the invention may be fully understood, there shall now be described preferred constructions of varying embodiments of the present invention, the description being with reference to the accompanying illustrated drawings in which.

DESCRIPTION OF PREFERRED EMBODIMENT

Figure 1:
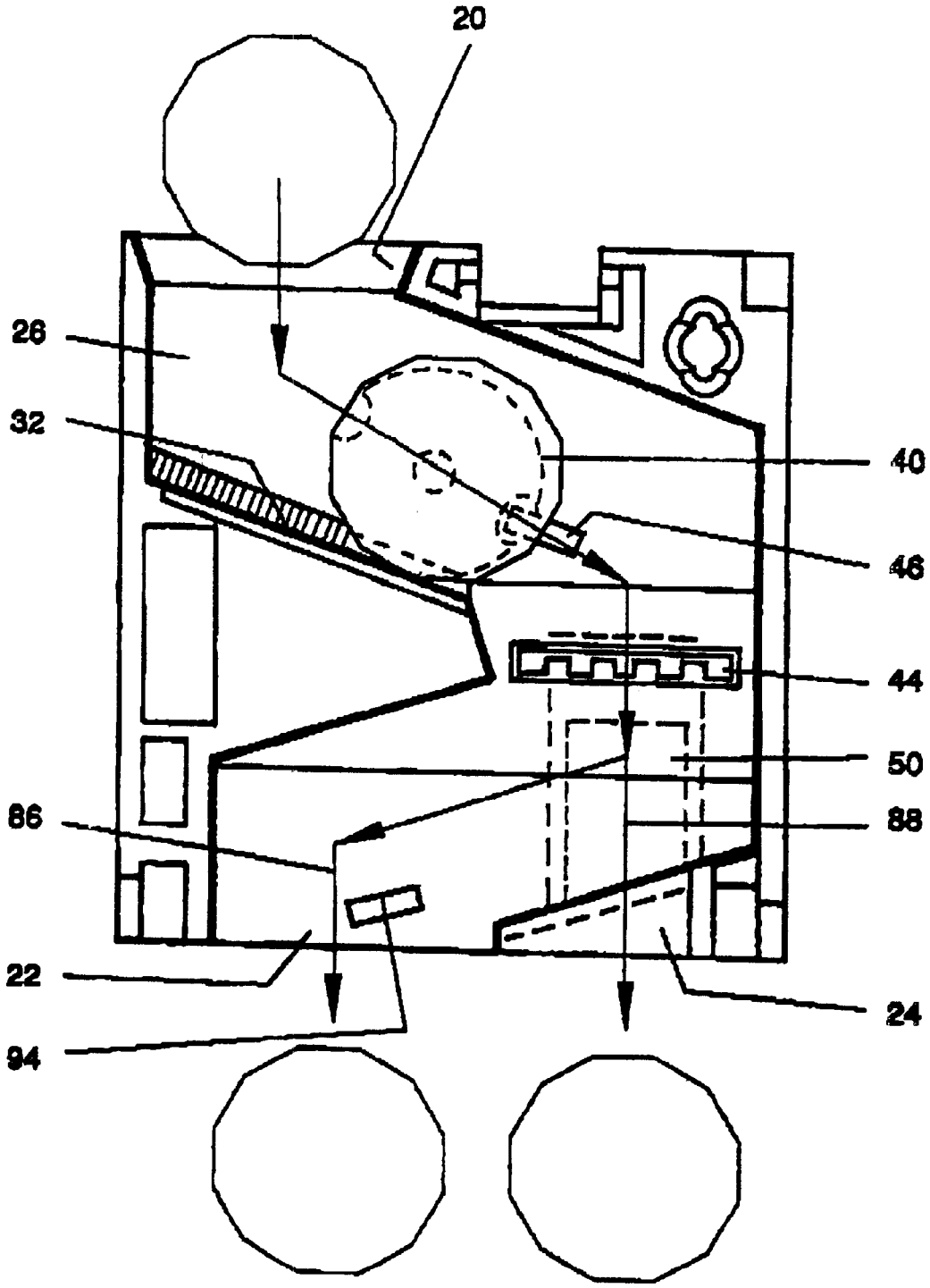
FIG. 1 is in an illustration of a typical S-path system operating prior to the creation of the present invention.

To refer firstly to FIG. 1, which shows the device described in our Australian Patent Application AU-B81826/91, a coin enters the coin accept slot under gravity where it strikes the coin rail 32. The coin rolls down the coin rail 32 and into the detect field 40. The detected field 40 is triggered when the leading edge of the coin interrupts an optical beam 46 which is arranged to cross the coin part 26. Coin validation takes place at this instance.

In the case of an invalid coin, the reject gate 44 remains closed and the coin is directed towards the coin reject slot 24. No credit is given. In the case of a valid coin, the reject gate 44 opens allowing the coin to pass towards the coin accept slot 22. Another optical beam 94 across the coin accept slot 24 indicates when the coin leaves the validator and initiates the appropriate credit output.

Figure 2:
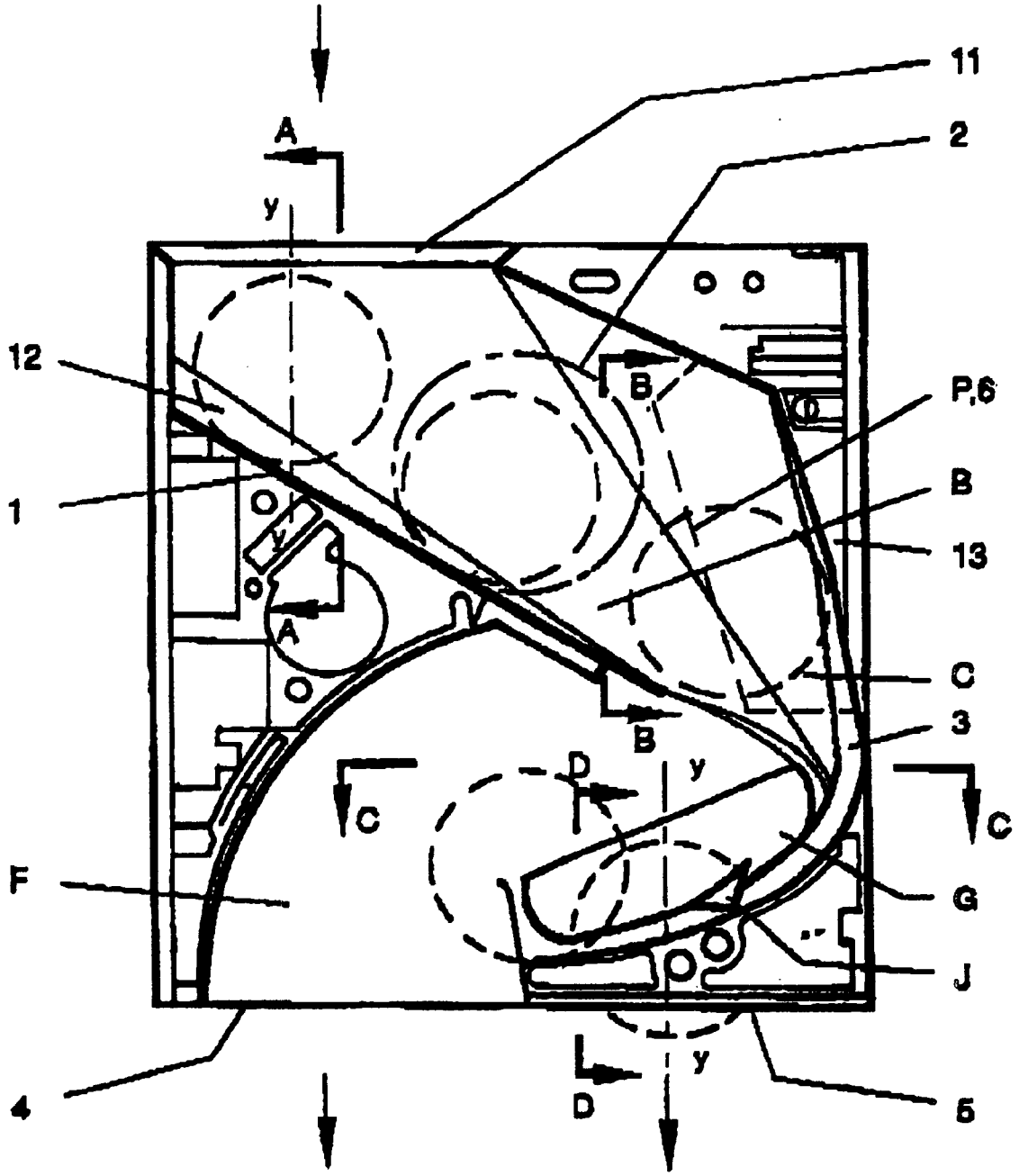
FIG. 2 is a view corresponding to FIG. 1 of a validator incorporating the principle features of the present invention.

To now refer to FIG. 2, which shows the principal features of the present invention, and where a coin enters at entry 11. The coin, at this time designated 12 and shown in relief throughout the figure, lands on a rail generally designated as 1 and rolls smoothly down rail 1 to the detect field 2. It remains in continuous contact with the rail 1 until it enters the coin transfer mechanism generally designated as 13. Here, the coin 12 transfers from rail 1 to the exit rail 3 and out the appropriate exit. This can be the accept path 4, or the reject path 5.

In this way the coin 12 is in continuous contact with the coin rail from the time of entry and contact with the first coin rail 1, through the transfer mechanism 13 and onto rail 3. It is only when it reaches either the reject path 5 or the accept path 4 at the very end of the validator that the coin ceases to contact a rail or be controlled by the various surfaces.

Figure 3:
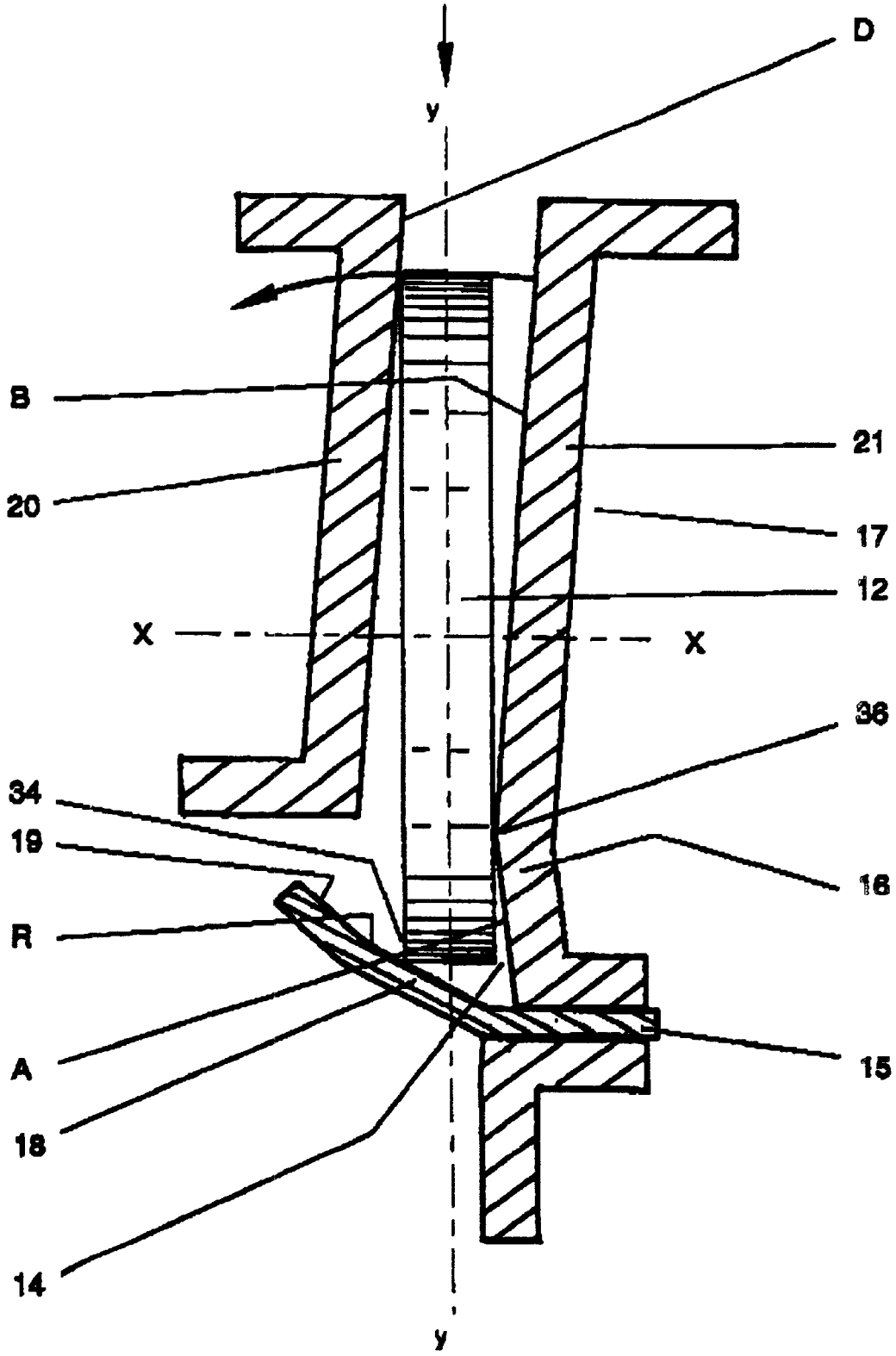
FIG. 3 is a vertical cross section along the lines and in the direction of arrows A—A of FIG. 2.

To refer now to FIG. 3, where the coin rail 1 is shown in detail, the rail mechanism consists of a number of static surfaces arranged in such a way to convert some of the kinetic energy of the falling coin 12 Impacting upon the rail 1 to rotary motion in two planes thereby eliminating rebound or bounce from the rail.

The leading edge of an incoming coin strikes surface generally designated as R of the rail 1. The rail 1 also has three portions—a first portion 15 extending perpendicular to and outwardly from a lower portion 16 of a first side wall generally designated as 17; a second portion 18 extending outwardly and upwardly from first portion 15; and a third portion 19 extending further outwardly and further upwardly from the second portion 18. The bottom left-hand edge 34 of the coin 12 therefore slides down the rail surface R, along the third portion 19 and, if of appropriate size, into contact with the second portion 18. The lower portion 16 of side wall 17 has a surface A and the lower edge of coin 12 locates between surface A and the upper surface of second portion 18, or third portion 19. The motion of the coin 12 sliding down the rail surface R causes the coin to pivot about the line 36 of intersection of surfaces A and B and to rotate about its axis XX until the upper edge of the coin 12 contacts the outer surface D of the second side wall 20. The included angle between surfaces A and B is less than 180° to cause the line 36. It is preferred that side wall 20 is formed by the access door of the validator.

The side wall 17 has an upper portion 21 which has a surface B. Upper portion 21 and second side wall 20 are generally parallel and spaced apart. It is also preferred that the second side wall 20 be aligned with the upper portion 21. The coin 12 therefore has, in general, three points of contact—where it contacts the surface D of second side wall 20, the surface R of second portion 18 or third portion 19 or rail 1, and the intersection line 36 of the surfaces A, B of lower portion 16 and upper portion 21 of side wall 17.

As shown in FIG. 2, as the rail 1 is on an angle, the impact point of the coin on the rail 1 is to the left of the coin axis YY, causing it to rotate about this axis. The combined rotation of the coin 12 about the axes XX (FIG. 3) and YY (FIG. 2) absorbs some of the kinetic energy created during the fall of the coin leaving the coin to roll down the rail.

Due to the nature of the construction of the rail 1, there is always provided a clearance 14 between the lower right edge of the coin, and surface A. This will tend to prevent the coin 12 bouncing as the edge at each side of the coin 12 cannot contact the two surfaces at the same time. Furthermore, the angled nature of rail 1 makes it difficult for coins to overlap as the angles are such that the leading edge of a trailing coin would contact the trailing edge of a leading coin, and remain in that relative position.

Figure 4:
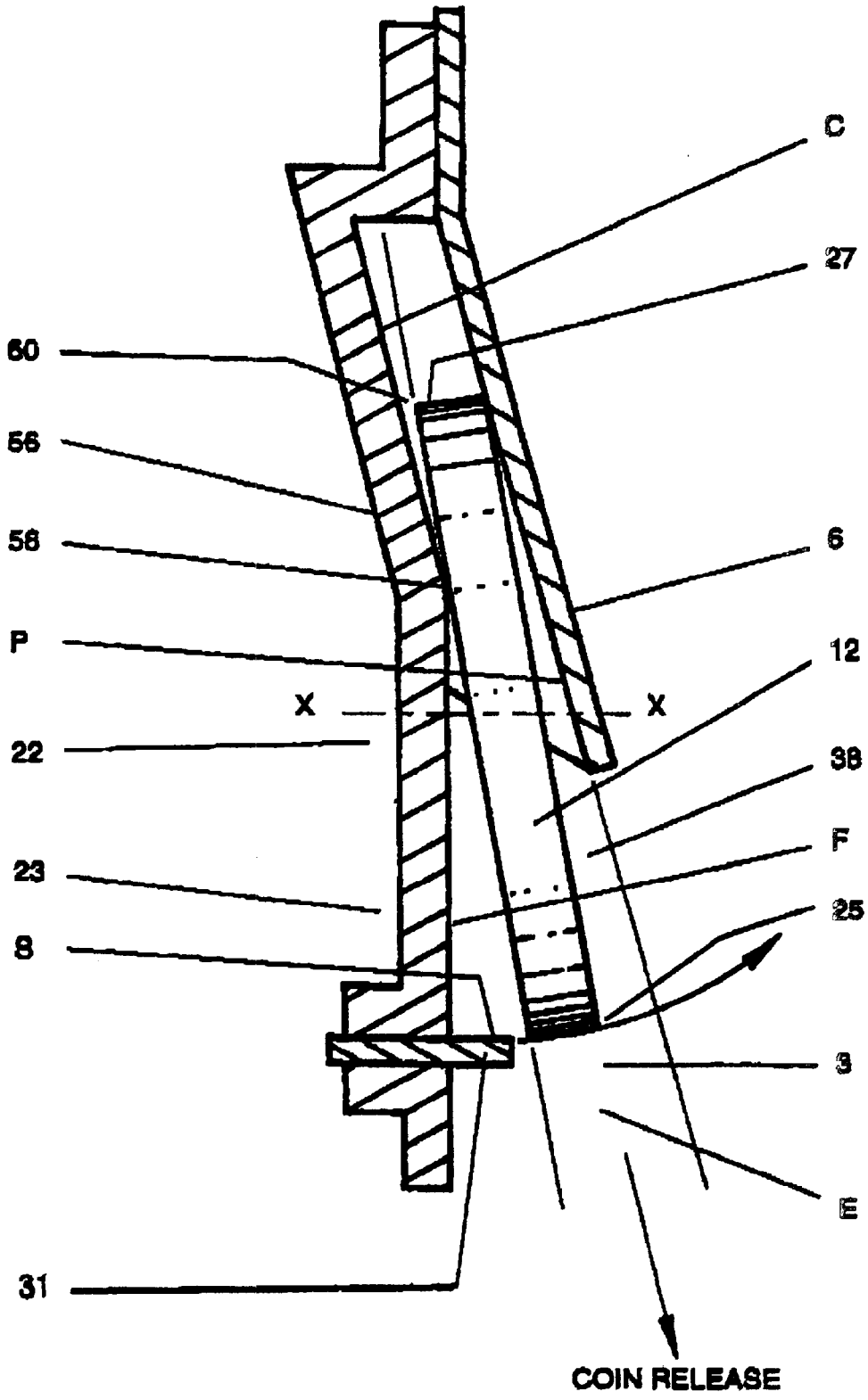
FIG. 4 is a cross sectional view along the lines of and in the direction of arrows B—B of FIG. 2.
Figure 5:
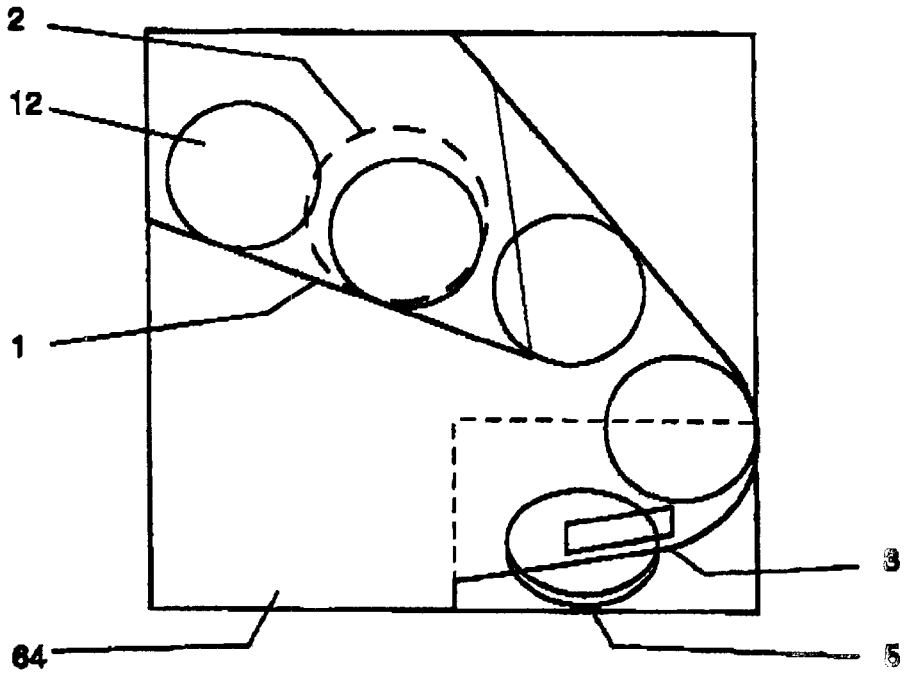
FIG. 5 is a schematic view corresponding to FIG. 2, showing the movement of coins through the validator.

In FIGS. 2 and 4, there is shown the transfer mechanism generally designated as 13. The mechanism consists of a number of static surfaces arranged in such a way to transfer the coin control from the entry rail 1 to the exit rail 3 and cause the coin to change direction by approximately 90° without bounce, loss of speed, or loss of control.

The control surfaces are provided on the chassis of the validator, and release plate 6 the edge of which is defined by the broken lines. The operation of the control surfaces is the same as those at the entry of the coin into the validator.

As the coin 12 rolls down the entry rail 1, the leading edge leaves the detect area 2 and passes under the release plate 6 contacting the inner surface P of release plate 6. The release plate surface P is arranged to form a converging wedge 38 with surface F of side wall 22, the surface F being on a lower portion 23 of side wall 22. Side wall 22 has an upper portion 56 which has a surface C. Surface C is inclined to surface F so as to provide a turning clearance for the coin with the included angle between surfaces C and F being less than 180°. Release plate 6 is generally aligned with rail 3.

As the leading edge of coin 12 slides under plate 6 into the wedge formed by surfaces P and F, it is rotated about line 58 being the intersection of surfaces C and F, and thus about its axis XX, into a plane roughly parallel with a surface (not shown) but generally designated by E. This action releases the coin 12 from being in contact with the surface S of the rail 31 which is the rail 1, but of a different profile. In this region the rail 31 tapers in its width to a reduced width to assist the transfer function. This then transfers the lower edge 25 of coin 12 to surface E, which at this time is the exit rail 3.

Naturally, the height of upper portion 24 and release plate 6 is intended to allow for coins 12 of varying diameter. It is preferred that the release plate 6 extends downwardly beyond the region where lower portion 23 joins with upper portion 24. It is further to be noted that a clearance 60 is provided between upper edge 27 of coin 12 and surface C.

The action of the coin 12 driving into the wedge 38 and the resultant rotation prevents bounce in a similar manner to the way in which bounce is prevented upon the coin entering the validator. The relative position of the surfaces ensures that the coin does not release from the rail 31 until the exit rail 3 assumes control over the coin. There is therefore continuous contact of the coin with a rail, and therefore control over the coin is maintained. At the entry into the validator, the coin 12 is controlled by surfaces A and B and restrained by surface D. At the transfer mechanism 13, the operation of surfaces F, C is the same as A, B, except that there is no surface D to restrain the coin.

In FIGS. 6, 6*a*, 6*b* and FIG. 7 there is shown in some detail the mechanism generally shown by the letter G of FIG. 2.

The mechanism G includes a solenoid activated gate to which is attached a cam 52 having a profile surface J which protrudes across rail 3 in a position above the reject opening 5.

Figure 6:
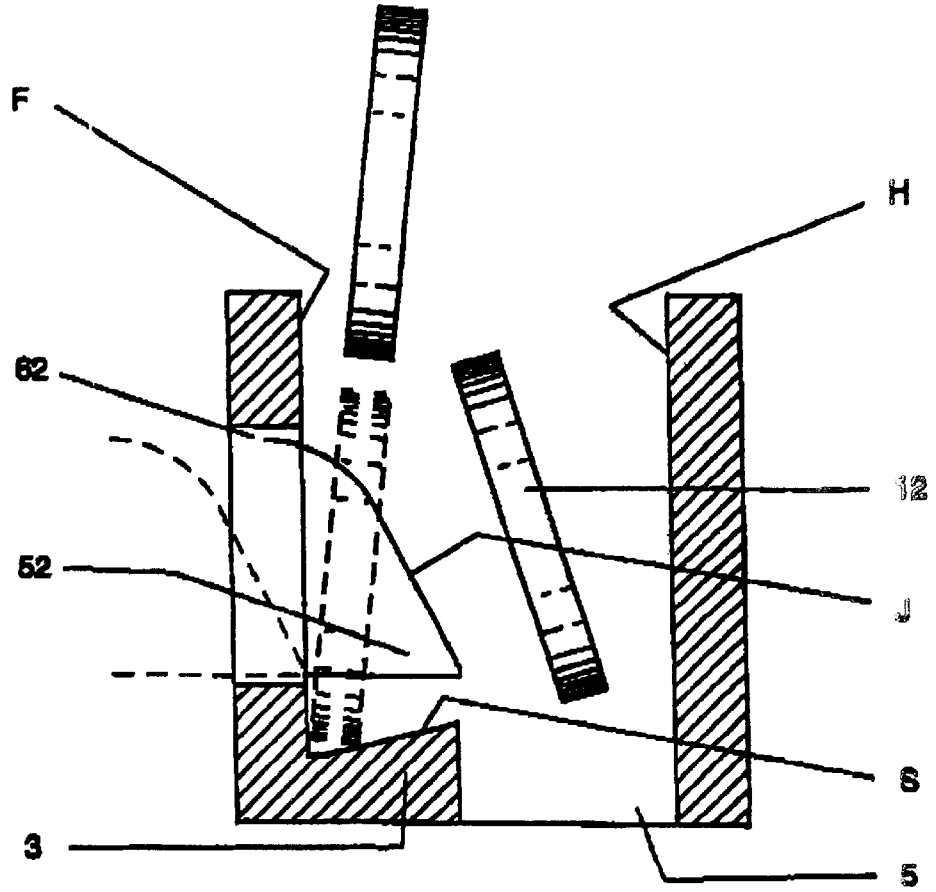
FIG. 6 is a cross sectional view along the lines and in the direction of arrows DD of FIG. 2 when in the first position.
Figure 6A:
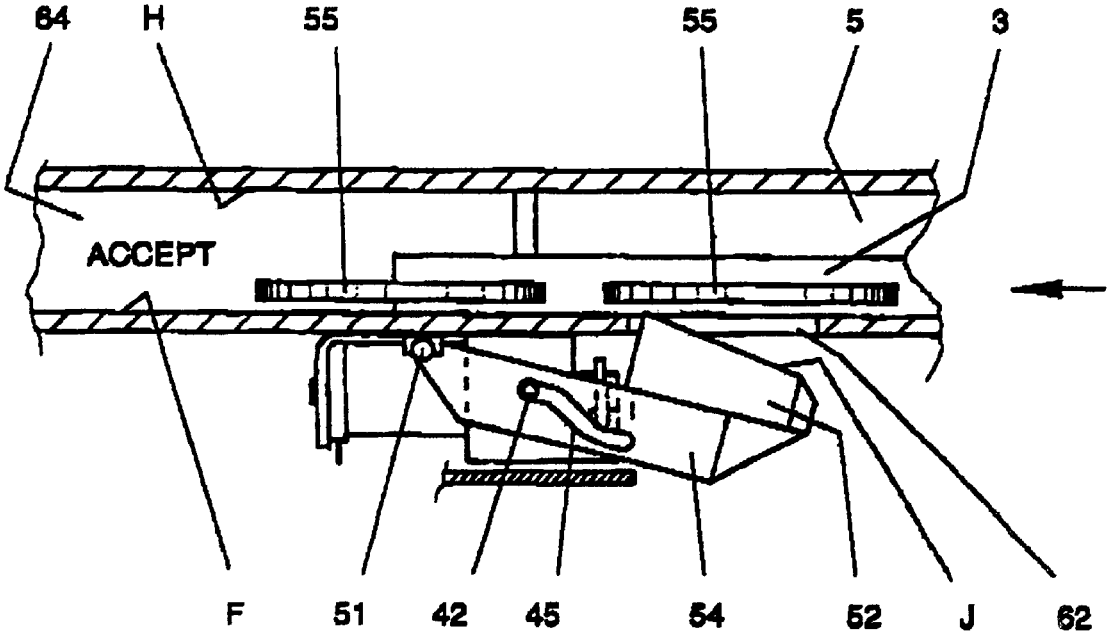
FIG. 6*a* is cross sectional view along the lines and in the direction of arrows C—C of FIG. 2 when in the first position.
Figure 6B:
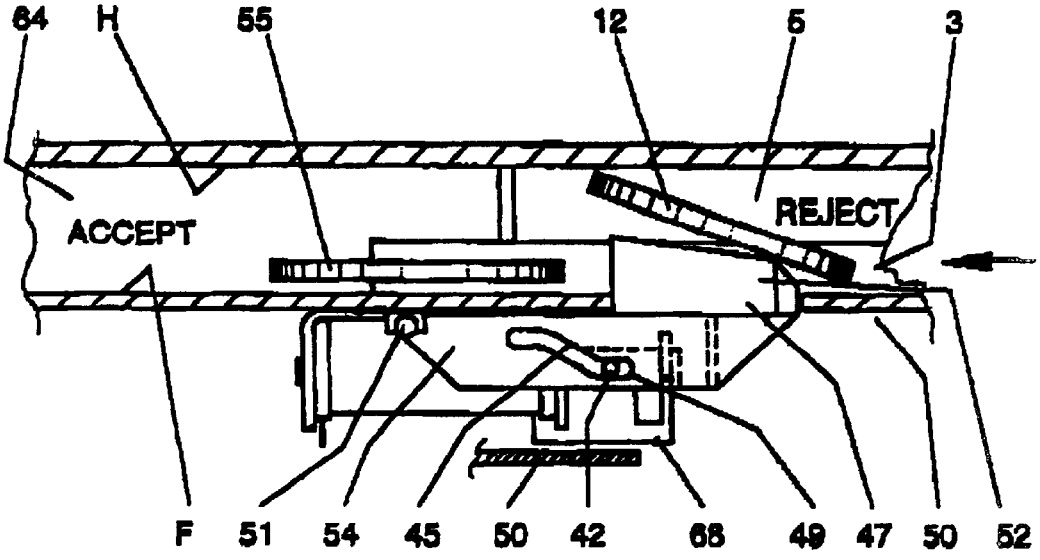
FIG. 6*b* is a view corresponding to FIG. 6*a* but in the second position.
Figure 7:
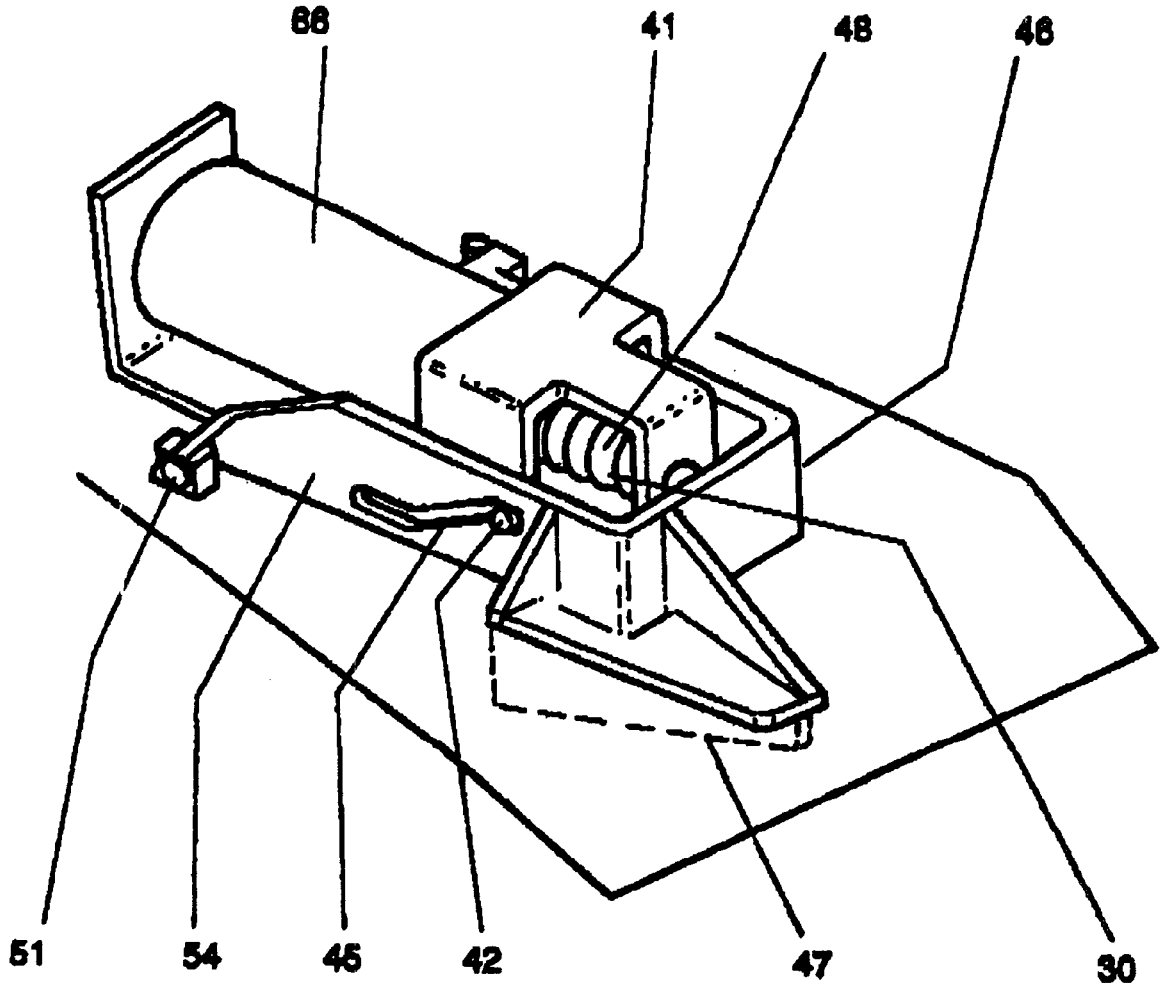
FIG. 7 is a perspective view of the gate of FIGS. 6*a* and 6*b*.

The leading edge of an invalid coin 12 rolling along the exit rail 3 strikes the reject cam surface J (FIG. 6). This action rotates the coin about axis YY of the coin 12, off the exit rail 3, and directs its leading edge into the exit opening 5 between surfaces F and H, where it is transferred laterally to be clear of the exit rail 3 and can fall under its own weight. In this way there are no surfaces on which the coin can jam, and thus the coin rail 3 is clear for a following coin.

This action has two definite advantages. Firstly, it transfers the coin 12 clear of a valid, following coin travelling along the exit rail 3 thereby rejecting the invalid coin without having to delay the valid coin until the rejected coin is clear of the exit rail 3. The valid coin 55 can pass along exit rail 3 and to the accept passage way 64, which is an opening between surfaces F and H. Coin rail 3 terminates above accept passageway 64.

The second advantage is because the surface J simply "kicks" the invalid coin off the rail 3 into the void 5 between surfaces F and H (which forms the reject coin exit pathway 5), there is no possibility of coin jams if there is a sequence error between the gate timing and the coin.

To refer to FIGS. 6, 6*a*, 6*b* and 7, a yoke 41 with two opposed pins 42 at each side is fitted to the end of a plunger 30 in an open frame solenoid 66, and is arranged to slide between two parallel surfaces 50. The yoke pins 42 run in somewhat S-shaped slots 45 formed in each side 54 of the reject gate 68, which is pivoted at one end at 51, with the other end 47 having a cam 52 with surface J.

In the reject position, whereby surface J of cam 52 protrudes over coin rail 3, via an opening 62 in surface F of exit rail 3, a return spring 48 extends the plunger 30 from the solenoid 66 such that the yoke pins 42 rest in flats 49 at the end of the slots 45 in the side walls 54 of the gate 68. These flats 49 are at right angles to the force applied on the reject gate 68 by a coin. As the yoke 41 is only able to slide in a plane parallel to the axis of the solenoid 66, any force applied to the reject gate 66 is at right angles to, and is therefore resisted by, the yoke pins 42 without any load being placed on the return spring 48 or solenoid 65. Therefore, the gate G is locked in position. To unlock the gate G to accept a valid coin 55, the solenoid 66 is activated. As the plunger 30 and yoke 41 retract, the yoke pins 42 leave the flat 49 and move into the inclined slots 45 in the sides 54 of reject gate 68. Because the yoke 41 can only move parallel to the axis of solenoid 66, the pins 42 lift the reject gate 68 to pivot about its end 51 which therefore rotates the gate 68 to clear surface J from the exit rail S.

The power to release the lock and accept a valid coin 55 is very small and need only overcome the light return spring 48 and the internal friction of the mechanism. This means that a small, low-powered solenoid 66 can be used. Furthermore, as the impact of a coin on the surface J is resisted by the locking mechanism, and not the return spring 48 on the solenoid 66, a weak return spring 48 can be used. If this were not the case, a much stronger return spring would be required to resist the coin load and therefore a much more powerful solenoid would be required to overcome that spring. As the force applied to the cam 52 is in a plane perpendicular to the slots 45 it cannot effect the location of the pins 42 in those slots 45, particularly when they are in the flats 49. If the force applied to the cam 52 is more than 90° to surface J, the force will assist the locating of the pins 42 in the flats 49 and thereby assist gate G remaining in the reject position. This provides a safety measure in that if there is a difficulty with a coin, it will be rejected, rather than be incorrectly accepted. Furthermore, in the event of a power failure, a coin will be rejected rather than accepted.

Whilst there has been described in the foregoing description preferred constructions of various embodiments incorporated in the principal features of the present invention. It will be understood by those skilled in the technology concern that many variations and modifications in details of design or construction may made without departing from the essential features of the presenting invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

We claim:

1. A device for handling and controlling coins of a range of sizes as they roll along a coin rail, the device including:

a coin entry through which a coin can pass to enter the device;

at least one coin exit through which the coin can pass as it leaves the device;

coin rail structure defining a single common path for coins of any size in said range of sizes in the device, said structure comprising:

at least one coin rail along which the coin rolls as the coin passes through the device from said coin entry to said coin exit, a first side wall having an upper portion and a second side wall spaced from and generally opposite said upper portion of the first side wall, which side walls provide surface means defining first and second lines of contact with respective sides of a coin of any size in said range of sizes as it rolls along the rail;

wherein said surface means and said rail are arranged so that said coin of any size in said range of sizes remains in contact with the coin rail and with the surface means as it rolls along said rail and thereby travels along said single common path.

2. A device as claimed in claim 1, wherein the coin rail is a continuous rail.

3. A device as claimed in claim 1, wherein the rail has a number of sections in succession between said coin entry and said at least one coin exit.

4. A device as claimed in claim 3, wherein the sections include a bounce control section extending from below the coin entry, a transfer section in which said coin is dislodged to change its direction of travel along said path, and an exit section which receives said coin from said transfer section.

5. A device as claimed in claim 4 wherein said first side wall is configured adjacent said transfer section of said rail to cause said dislodgement of the coin in said transfer section for receipt by said exit section of the rail.

6. A device as claimed in claim 5, wherein, adjacent said transfer section of the rail structure, said second side wall is provided by a release plate having an inner surface contactable by a coin, said release plate cooperating with said first side wall to effect said dislodgement.

7. A device as claimed in claim 6, wherein the release plate and a lower portion of the first side wall in said transfer section of said rail structure form a converging wedge.

8. A device as claimed in claim 7, wherein the release plate is aligned with the upper portion of said first side wall and extends downwardly beyond said lines of contact.

9. A device for handling coins as claimed in claim 1 wherein said first line of contact is defined by a surface intersection line between a pair of mutually adjacent surfaces of said first side wall, which surfaces are positioned with respect to each other at an included angle of less than 180°.

10. A device as claimed in claim 9, wherein the second side wall extends downwardly below the surface intersection line.

11. A device as claimed in claim 9, wherein the second side wall is opposite and aligned with the upper portion of the first side wall.

12. A device as claimed in claim 9, wherein said first side wall extends generally upwardly from said rail, the first side wall further having a lower portion and said upper portion extending upwardly from the lower portion, which upper and lower portions define said mutually adjacent surfaces.

13. A device as claimed in claim 12, wherein the lower portion of the first side wall is of a lesser height than the diameter of a coin to pass therealong.

14. A device as claimed in claim 13, wherein the second side wall extends downwardly below the surface intersection line.

15. A device as claimed in claim 12, wherein the first side wall extends generally upwardly from said rail, the first side wall further having a lower portion and said upper portion extending upwardly from said lower portion, which upper and lower portions define said mutually adjacent surfaces; said rail having: a first portion extending outwardly from and generally perpendicular to the lower portion of the first side wall, a second portion extending outwardly and upwardly from the first portion, and a third portion extending further outwardly and further upwardly from the second portion.

16. A device as claimed in claim 12, wherein said first side wall extends generally upwardly from said rail, the first side wall further having a lower portion and said upper portion extending upwardly from said lower portion, which upper and lower portions define said mutually adjacent surfaces, and a second side wall spaced from and generally parallel to the upper portion of the first side wall, the second side wall being opposite and aligned with the upper portion of the first side wall.

17. A device as claimed in claim 12, wherein said rail has a first portion extending outwardly from and generally perpendicular to said lower portion of the first side wall.

18. A device as claimed in claim 17, wherein the first portion of said rail is of the same or lesser width than the width of a coin to pass therealong.

19. A device as claimed in claim 17, wherein said rail has a second portion extending outwardly and upwardly from the first portion.

20. A device as claimed in claim 19, wherein said rail has a third portion extending further outwardly and further upwardly from the second portion.

21. A device for handling and controlling coins of a range of sizes as they roll along a coin rail, the device including:

a coin entry through which a coin can pass to enter the device;

coin rail structure defining a single common path for coins of any size in said range of sizes in the device, said structure comprising:

at least one coin rail along which the coin rolls as the coin passes through the device, a first side wall having an upper portion and a pair of mutually adjacent surfaces positioned with respect to each other at an included angle of less than 180° to define between the adjacent surfaces a surface intersection line disposed with respect to the coin rail so as to contact a side of a coin of any size in said range of sizes as the coin is in contact with and rolls along said rail, thereby causing the coin to rotate about the surface intersection line, and a second side wall spaced from and generally opposite said upper portion of the first side wall, which second side wall forms means to restrain said rotation of said coin of a size in said range of sizes;

whereby to substantially control movement of the coin on the coin rail structure as the coin rolls along said rail and thereby travels along said single common path.

22. A device as claimed in claim 21, wherein said first side wall extends generally upwardly from said rail, the first side wall further having a lower portion and said upper portion extending upwardly from said lower portion, which upper and lower portions define said mutually adjacent surfaces; said rail having: a first portion extending outwardly from and generally perpendicular to the lower portion of the first side wall, a second portion extending outwardly and upwardly from the first portion, and a third portion extending further outwardly and further upwardly from the second portion.

23. A device as claimed in claim 22, wherein the first portion of the rail is of the same or less width that the width of a coin to pass therealong, and the lower portion of the first side wall is of a lesser height than the diameter of a coin to pass therealong.

24. A device as claimed in claim 21, wherein said first side wall extends generally upwardly from said rail, the first side wall further having a lower portion and said upper portion extending upwardly from said lower portion, which upper and lower portions define said mutually adjacent surfaces, and wherein said second side wall is spaced from and generally parallel to the upper portion of the first side wall, the second side wall being opposite and aligned with the upper portion of the first side wall.

25. A device as claimed in claim 21, wherein said surface intersection line and said restraining means extend longitudinally of said rail whereby a coin is in substantially continuous contact with the coin rail, with said surface intersection line and with said restraining means as it rolls along the rail.

26. A device as claimed in claim 25 further including at least one coin exit through which the coin can pass as it leaves the device.

27. A device as claimed in claim 21, wherein the control of movement is to reduce or substantially prevent bounce of the coin.

28. A device as claimed in claim 21, wherein the rail structure includes a bounce control section, a transfer section, and an exit section, and said control of movement is to transfer the coin, in the transfer section, from the bounce control section of the coin rail structure to the exit section while maintaining contact of the coin with the coin rail structure.

29. A device as claimed in claim 28, wherein the transfer section of the coin rail structure has a transfer section of said rail, and said first side wall is configured adjacent said transfer section of said rail to cause dislodgement of the coin from said transfer section for receipt by said exit section of the rail, the second side wall in said transfer section being provided by a release plate having an inner surface contactable by a coin, said release plate cooperating with said first side wall to effect said dislodgement, the release plate and a lower portion of the first side wall forming a converging wedge, the release plate being aligned with the upper portion of said first side wall and extending downwardly beyond said surface intersection line.

30. A device as claimed in claim 28, wherein the transfer section of the coin rail structure has a transfer section of said rail, and said first side wall is configured adjacent said transfer section of said rail to cause dislodgement of the coin from said transfer section for receipt by said exit section of the rail.

31. A device as claimed in claim 30, wherein, in said transfer section of the rail structure, said second side wall is provided by a release plate having an inner surface contactable by a coin, said release plate cooperating with said first side wall to effect said dislodgement.

32. A device as claimed in claim 31, wherein the release plate and a lower portion of the first side wall in said transfer section of said rail structure form a converging wedge.

33. A device as claimed in claim 32, wherein the release plate is aligned with the upper portion of said first side wall and extends downwardly beyond said surface intersection line.

34. A device as claimed in claim 21, wherein said first side wall extends generally upwardly from said rail, the first side wall further having a lower portion and said upper portion extending upwardly from the lower portion, which upper and lower portions define said mutually adjacent surfaces.

35. A device as claimed in claim 34, wherein the lower portion of the first side wall is of a lesser height than the diameter of a coin to pass therealong.

36. A device as claimed in claim 34, wherein said rail has a first portion extending outwardly from and generally perpendicular to said lower portion of the first side wall.

37. A device as claimed in claim 36, wherein the first portion of said rail is of the same or less width than the width of a coin to pass therealong.

38. A device as claimed in claim 36, wherein said rail has a second portion extending outwardly and upwardly from the first portion.

39. A device as claimed in claim 38, wherein said rail has a third portion extending further outwardly and further upwardly from the second portion.

40. A device as claimed in claim 21, wherein the second side wall is opposite and aligned with the upper portion of the first side wall.

41. A device as claimed in claim 21, wherein the second side wall extends downwardly below the surface intersection line.

* * * * *